US007213276B2

(12) United States Patent
Palma

(10) Patent No.: US 7,213,276 B2
(45) **Date of Patent: *May 8, 2007**

(54) SHOWER BODY SUPPORT

(76) Inventor: Stanley J. Palma, 6469 Harrison Ridge Blvd., Indianapolis, IN (US) 46236

( * ) Notice: Subject to any disclaimer, the term of this patent is extended or adjusted under 35 U.S.C. 154(b) by 379 days.

This patent is subject to a terminal disclaimer.

(21) Appl. No.: 10/891,923

(22) Filed: Jul. 15, 2004

(65) Prior Publication Data

US 2005/0044622 A1 Mar. 3, 2005

Related U.S. Application Data

(63) Continuation-in-part of application No. 10/651,344, filed on Aug. 28, 2003, now Pat. No. 6,922,857.

(51) Int. Cl.
*A47K 3/12* (2006.01)

(52) U.S. Cl. ..... 4/611; 4/573.1

(58) Field of Classification Search ..... 4/571.1, 4/573.1, 576.1, 577.1, 579, 604, 611
See application file for complete search history.

(56) References Cited

U.S. PATENT DOCUMENTS

| | | | | |
|---|---|---|---|---|
| 1,297,980 | A | 3/1919 | Weinberger | 4/559 |
| 3,638,647 | A | 2/1972 | Creelman | 128/133 |
| 3,990,120 | A | 11/1976 | Rankin | 4/573.1 |
| 4,498,204 | A | 2/1985 | Warner | 4/559 |
| 4,998,305 | A | 3/1991 | Davis | 4/604 |
| 5,263,207 | A | 11/1993 | Gilbert | 4/562.1 |
| 5,329,651 | A | 7/1994 | Mardero et al. | 4/605 |
| 5,337,525 | A | 8/1994 | Zaccai et al. | 4/578.1 X |
| 5,365,618 | A | 11/1994 | Gilbert | 4/563.1 |
| 5,465,437 | A | 11/1995 | Herman | 4/611 |
| 5,970,535 | A * | 10/1999 | Wayne | 4/576.1 |
| 6,381,772 | B1 | 5/2002 | Dawson | 4/578.1 |
| 6,505,803 | B1 * | 1/2003 | Hernandez | 248/354.5 |
| 6,922,857 | B2 * | 8/2005 | Palma | 4/611 |

* cited by examiner

*Primary Examiner*—Robert M. Fetsuga
(74) *Attorney, Agent, or Firm*—Welsh & Katz, Ltd.

(57) ABSTRACT

A system for providing support in the shower, such as a toroidal support which can open and can be secured around a bather's chest. In some embodiments, the support can be coupled to a vertical spine which is coupled to the shower enclosing structure.

27 Claims, 10 Drawing Sheets

40
55
66
65
77
75
85
97a
95
97a
67
56

SHOWER BODY SUPPORT

This invention pertains to a system for providing support in the shower. This application is a continuation in part of Ser. No. 10/651,344 which was filed on 28 Aug. 2003, and which issued on 2 Aug. 2005 as U.S. Pat. No. 6,922,857.

BRIEF DESCRIPTION OF THE DRAWINGS

The components in the figures are not necessarily to scale.

DETAILED DESCRIPTION OF SOME EMBODIMENTS

Figure 1:
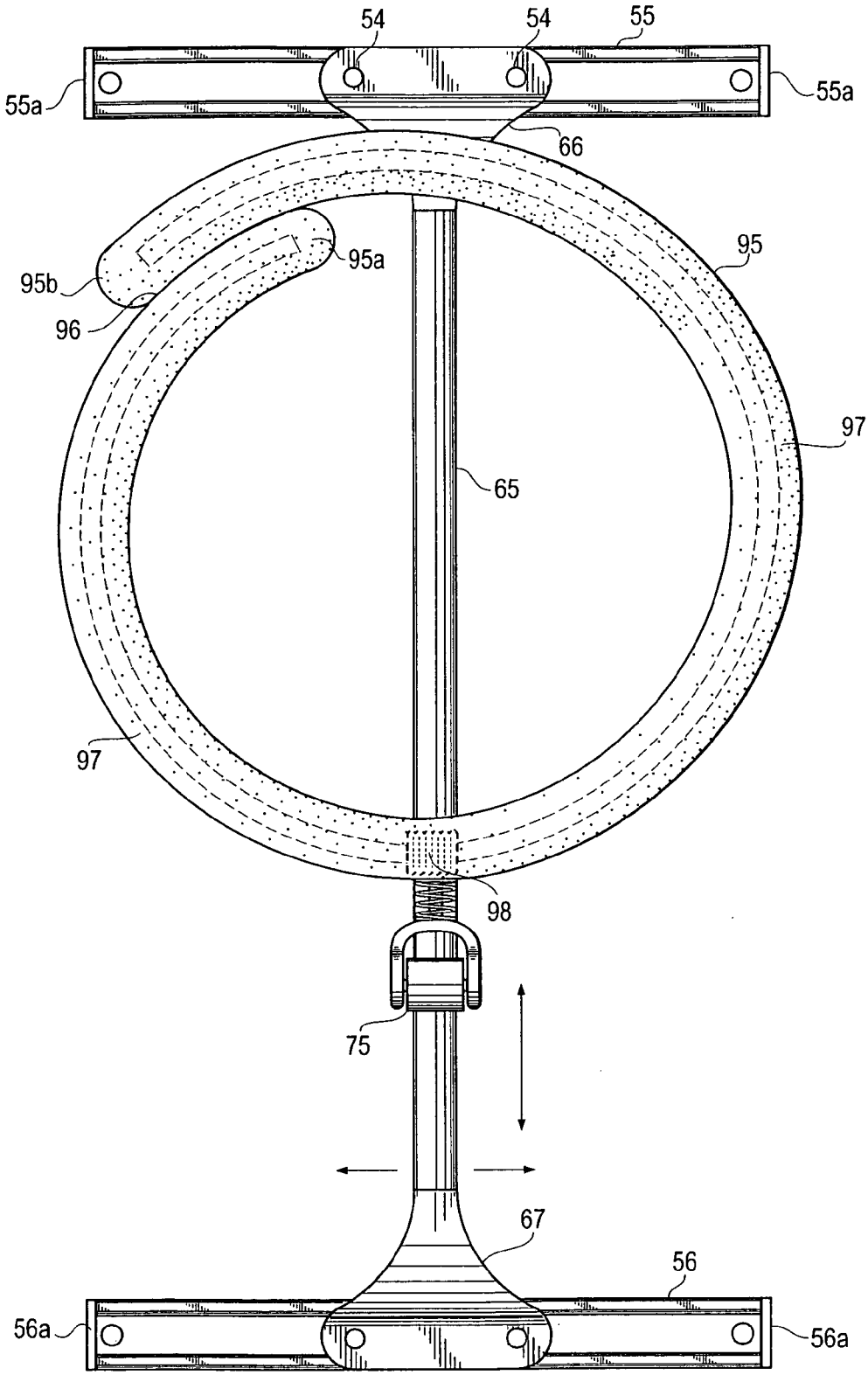
FIG. 1 is a front view of one embodiment with the body support in a raised position.

While the present invention is susceptible of embodiment in various forms, there is shown in the drawings and will hereinafter be described some embodiments with the understanding that the present disclosure is to be considered an exemplification of the invention and is not intended to limit the invention to the specific embodiments illustrated.

FIG. 1 is a front view of one embodiment of the invention. In the example of FIG. 1, a generally toroidal body support 95 can be mechanically coupled to a structure, such as a wall or other parts of structure, enclosing a shower. For example, the body support can be used by elderly persons, special education children, or others who are physically capable of standing and using their arms, but who can use the body support to reduce the likelihood of injury if they slip in the shower. A "shower" can be any space in which one showers, such as a bath tub, a shower stall, a shower room, etc.

Figure 12:
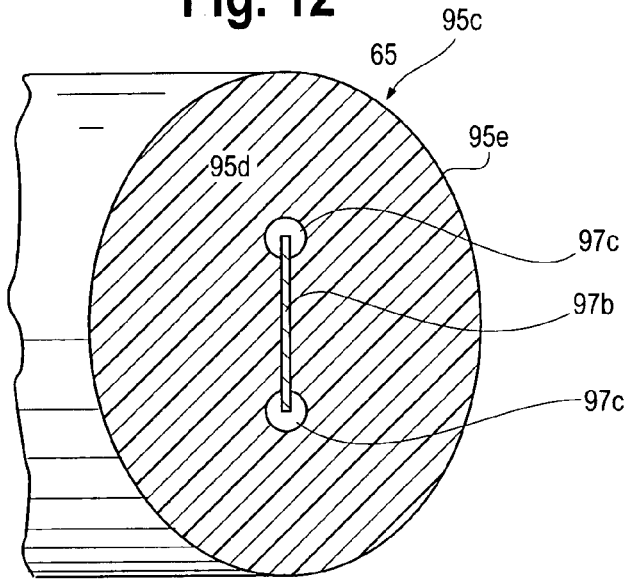
FIG. 12 is a partial cross-sectional view of another embodiment of the body support.
Figure 27:
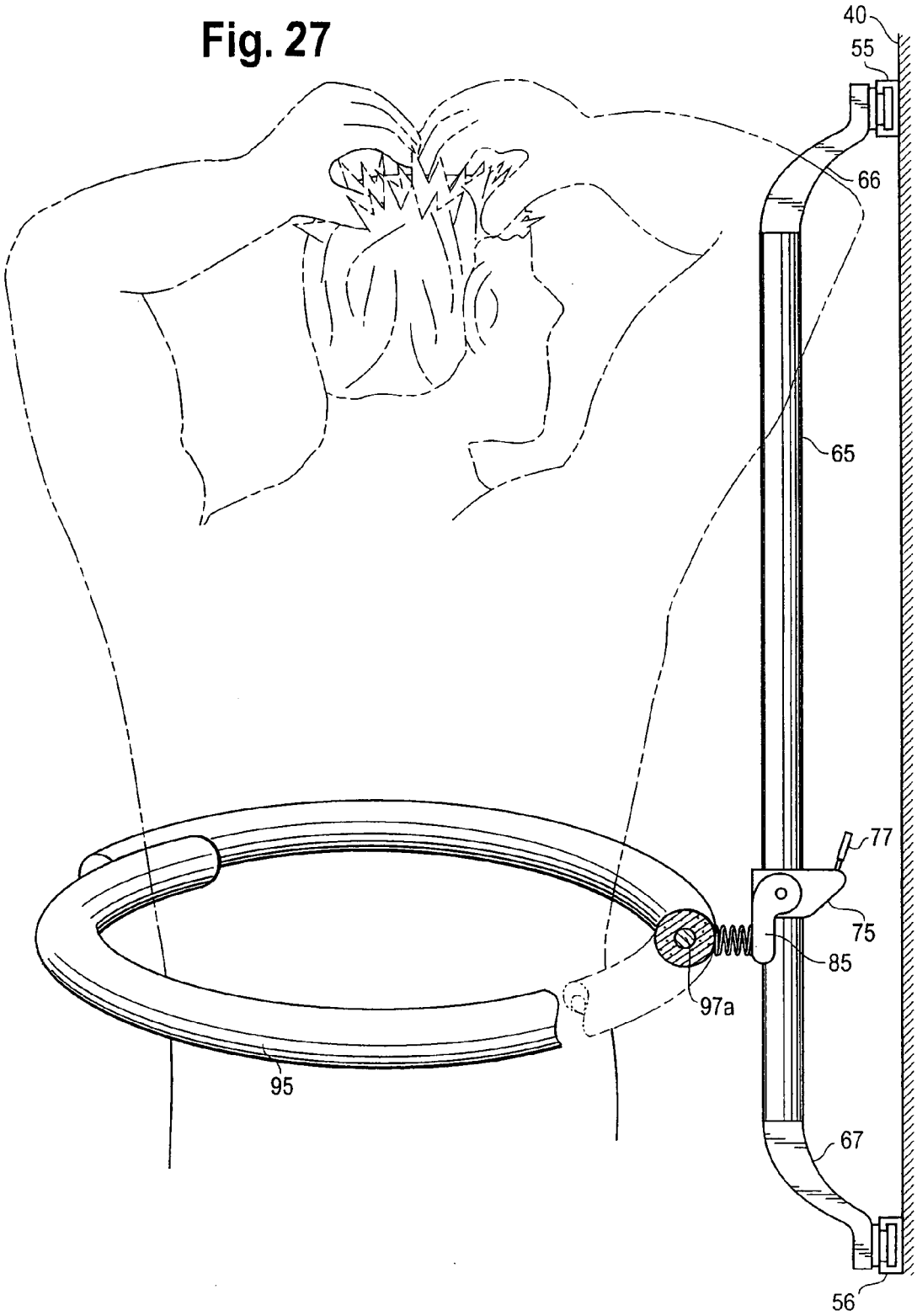
FIG. 27 is similar to FIG. 2, with the body support surrounding a person shown in phantom.

A bather should be able generally to wrap the body support 95 around at about chest level under the bather's arms, as shown in FIG. 27. Body support 95 can be, for example, closed cell foam around reinforcement. For example, the reinforcement can be a metal reinforcement such as metal tube 97 as in FIG. 1, steel cable 97*a* as in FIG 2, or flexible steel ribbon 97*b* as in FIG. 12, or it can be other materials known in the art. The foam can comprise a waterproof coating. In the example of FIG. 12, body support 95*c* comprises steel ribbon 97*b* surrounded by closed cell foam 95*d* with a waterproof coating or finish 95*e*. Also in the example of FIG. 12, plastic guards 97*c* protect against the edges of steel ribbon 97*b* cutting through the foam 95*d*. These are only examples, and other materials can be used as is well known in the art.

In the example of FIG. 1, body support 95 includes regions 95*a* and 95*b* which can be separated from each other to allow a bather to enter or to leave. In the example of FIG. 1, regions 95*a* and 95*b* can be secured to each other to enhance the support provided by body support 95. In the example of FIG. 1, regions 95*a* and 95*b* are secured to each other with VELCRO® (or a nylon fabric that can be fastened to itself) fastening 96, but other fasteners (or means for fastening) can be used, such as hooks, snaps, zippers, and so forth, as is well known in the art.

There can be various means for allowing separation of regions 95*a* and 95*b*. For example, in the example of FIG. 1, spring connection 98 couples two parts of metal tube reinforcement 97 to facilitate movement of regions 95*a* and 95*b* relative to each other. In other examples, there can be another type of connection, or the reinforcement can be sufficiently flexible that there is no need for it to have two parts which are coupled.

The body support, such as body support 95 of FIG. 1, can be coupled to a structure via different coupling elements (and different combinations of those elements) between the body support and the structure (various examples of means for coupling the body support to the structure being illustrated in FIGS. 1–11 and 13–27), and in different ways which permit different movements relative to the structure. For example, it could be fixed to a single location on a wall or it could be allowed to move horizontally along a wall. In preferred embodiments, the body support is coupled to a vertical spine such as spine 65 of FIG. 1, and the height of that coupling can be adjusted such as to accommodate persons of different heights.

A system contemplated by the invention can be designed into new construction showers or can be built into already existing showers. A method contemplated by the invention can be an implementation or a use of the system. In some embodiments, a vertical spine can be secured to a structure enclosing a shower such as to a wall adjacent a column behind the wall. In other embodiments, upper and lower horizontal mounting bars can be secured to a wall such as spanning the distance between two columns behind the wall, and a vertical spine can be coupled to the mounting bars at a location which is desirable relative to a shower head for example. In some embodiments, there can be covers over attachments to the wall. For example, there can be plastic covers which can, for example, snap over the attachments.

Various examples of means for adjusting the lateral position of a vertical spine are discribed in the next few paragraphs. For example, in the embodiment of FIG. 1, spine 65 includes upper and lower spine caps 66 and 67, respectively. Spine caps 66 and 67 are movingly coupled to upper and lower mounting tracks 55 and 56, respectively. In the example of FIG. 1, the height of body support 95 can be adjusted along vertical spine 65, and spine 65 can move laterally along mounting tracks 55 and 56. End blocks, such as caps 55*a* and 56*a*, pegs, or other similar mechanisms well known in the art, can prevent moving spine 65 beyond the ends of mounting tracks 55 and 56.

Figure 8:
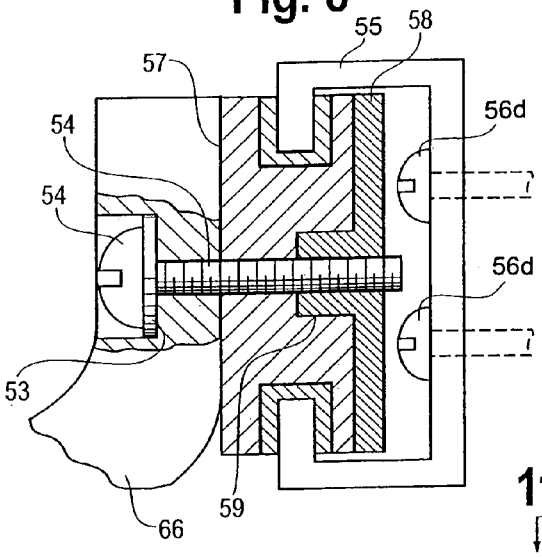
FIG. 8 is a partial side view of the upper spine cap and mounting track of one embodiment, with some of the coupling elements in cross-section.

FIG. 8 shows a partial side view of upper spine cap 66 with upper mounting track 55 and certain coupling elements in cross-section. In the example of FIG. 8, mounting track 55 can be secured ot a wall by screws 56*d*. Mounting brackets (not shown) can also be used. In other embodiments, other fasteners can be used as is well known in the art. Spine cap 66 is coupled to slide block 57 and backing plate 58 with integral nut 59 by screws 54 with reinforcements 53. In other embodiments, other fastening mechanisms can be used as is well known in the art. As seen in FIG. 8, slide block 57 can slide in mounting track 55.

Figure 15:
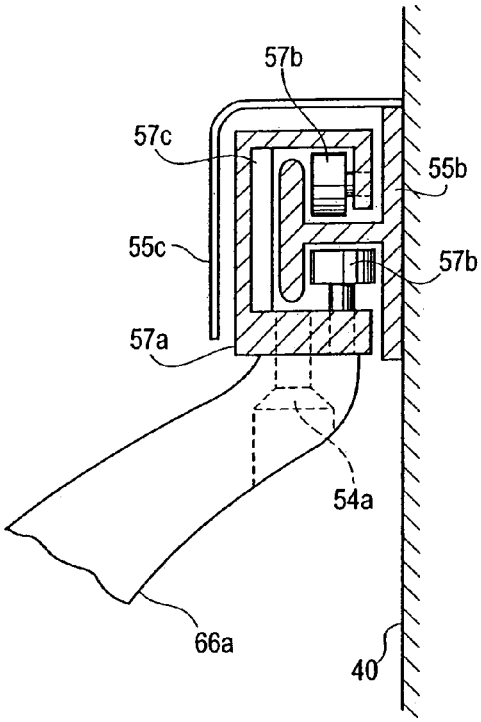
FIG. 15 is a partial side view of the upper spine cap and mounting track of another embodiment in one simulated environment, with some of the coupling elements in cross-section.
Figure 16:
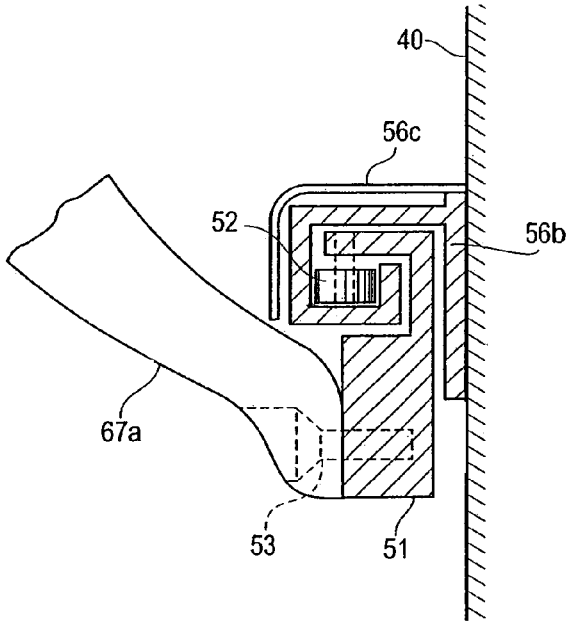
FIG. 16 is a partial side view of the lower spine cap and mounting track of another embodiment in one simulated environment, with some of the coupling elements in cross-section.

FIGS. 15 and 16 show an alternate embodiment. In the example of FIG. 15, upper mounting track 55*b* can be secured to wall 40, such as with screws or other fasteners. Upper spine cap 66*a* is coupled to slide block 57*a* with countersunk machine screw 54*a*, but other fasteners can be used as is known in the art. Slide block 57*a* includes rollers 57*b* for moving engagement with mounting track 55*b*. In the example of FIG. 15, slide block 57*a* can be formed of metal and can include anti-friction block 57*c*, which may be formed of nylon, for example. Other suitable materials can be used as is known in the art. In the example of FIG. 15, there is a cover 55*c* over these coupling elements. The cover 55*c* may be formed of plastic or other materials as is known in the art.

In the example of FIG. 16, lower mounting track 56*b* can be secured to wall 40, such as with screws or other fasteners. Lower spine cap 67*a* is coupled to slide block 51 with countersunk screws 53, but other fasteners can be used as is known in the art. Slide block 51 can be formed of metal or other materials as is known in the art. Slide block 51 can include rollers 52 for moving engagement with mounting track 56*b*. In the example of FIG. 16, there is a cover 56*c* over these coupling elements. The cover 56*c* may be formed of plastic or other materials as is known in the art.

Figure 17:
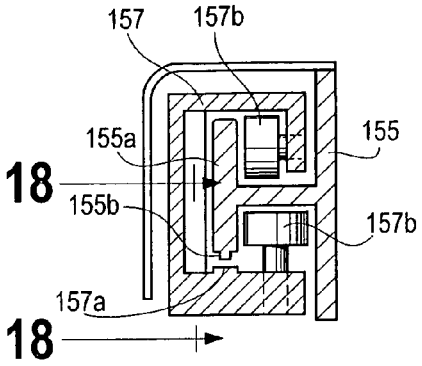
FIG. 17 is a partial side view of the slide block and upper mounting track of another embodiment.
Figure 18:
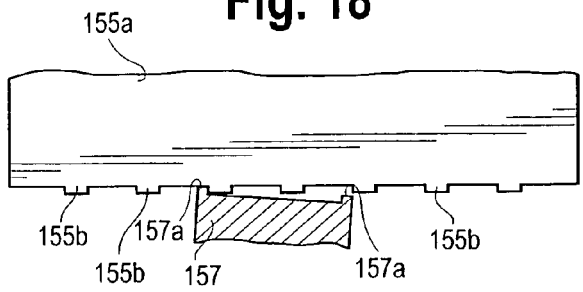
FIG. 18 is a partial cross-sectional front view of the embodiment of FIG. 17, with the angle of the sliding block relative to the mounting track changed.

FIGS. 17 and 18 show an alternate embodiment of a slide block and a mounting track. Protrusions are included to inhibit lateral sliding if the angle of the slide block relative to the mounting track changes, such as might occur if a bather slips. That is, the protrusions can act as stopping surfaces to inhibit the slide block from moving as discussed in the next paragraph. For example, such protrusions can be included on the slide block, the mounting track, or both.

In the example of FIGS. 17 and 18, upper mounting track 155 includes a series of protrusions 155*b* extending down from front rail 155*a*. For example, protrusions 155*b* could be spaced apart about ¾" or more, and could extend down about ⅛" from the bottom of rail 155*a*. In the example of FIGS. 17 and 18, slide block 157 includes two protrusions 157*a* at or near the lateral edges, respectively, of slide block 157 and positioned close to the bottom of rail 155*a*. When slide block 157 is level, rollers 157*b* can travel freely and slide block 157 can move smoothly along mounting track 155. In the example of FIG. 18, the angle of slide block 157 is changed relative to mounting track 155, and one protrusion 157*a* and one protrusion 155*b* can engage to inhibit lateral sliding of slide block 157.

Spine 65 can be formed of hard rubber, steel, fiberglass, urethane or other plastic, or other materials. Spine caps 66, 66*a*, 67 and 67*a* can be formed of hard rubber with steel inserts, urethane with steel inserts, cast metal, or other materials. Mounting tracks 55, 55*b*, 56, 56*b*, and 155 can be aluminum extrusions or can be formed of other materials or in other ways. End caps 55*a* and 56*a* can be formed of hard rubber, plastic, or other materials. Slide blocks 57 and 157 can be formed of TEFLON® (or synthetic flourine-containing resins), nylon, or other materials. Backing plate 58 can be formed of steel or other materials. Reinforcement 53 can be formed of steel or other materials.

A body support, such as body support 95, can be coupled to a vertical spine, such as spine 65, in different ways. Various examples of means for adjusting the height of a body support are described in the next few paragraphs. For example, in the example of FIG. 1, body support 95 is coupled to a collar 75. Collar 75 can be adjusted up and down spine 65, as illustrated in FIGS. 3 through 6 for example. In that example, part of the surface of spine 65, and particularly the part of spine 65 facing the wall in the example of FIGS. 3 through 6, is molded with or otherwise includes successive catch areas 68. A catch 76 is rotatably coupled to collar 75, such as about pivot shaft 78. A spring such as axial spring 79 biases the orientation of catch 76 relative to collar 75, to engage catch 76 in a catch area 68 and to prevent collar 75 from moving along spine 65 in at least one direction.

In the example of FIGS. 3 through 6, catch 76 includes a catch release paddle 77. Paddle 77 can be integral with the rest of catch 76, or can be formed separately and can be coupled to the rest of catch 76 such as, for example, by screwing into the rest of catch 76. Paddle 77 can be rotated about pivot shaft 78 against the bias of spring 79 to move catch 76 out of a catch area 68, and to allow collar 75 to be adjusted up or down along spine 65.

Figure 4:
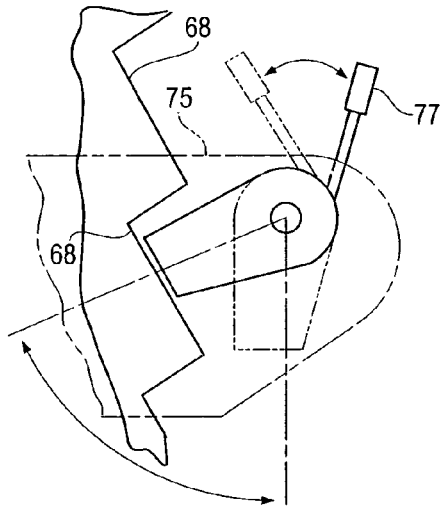
FIG. 4 is a partial side view, showing parts of the spine, the collar and the catch of the embodiment of FIG. 3, the part of the catch enclosed in the collar shown in phantom, the rotated catch and paddle also shown in phantom.
Figure 5:
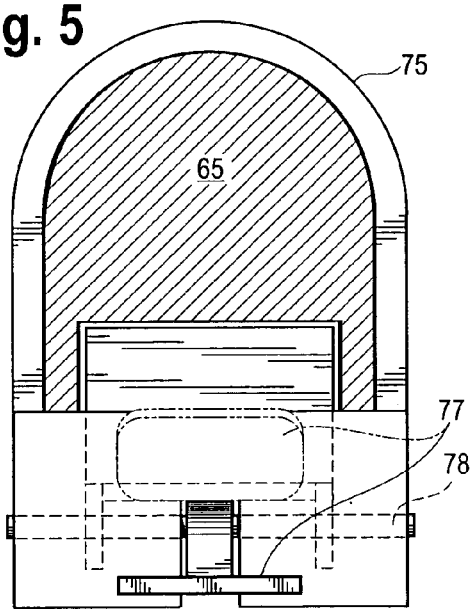
FIG. 5 is a partial top view, showing parts of the collar and catch of the embodiment of FIG. 3, with the spine in cross-section.
Figure 6:
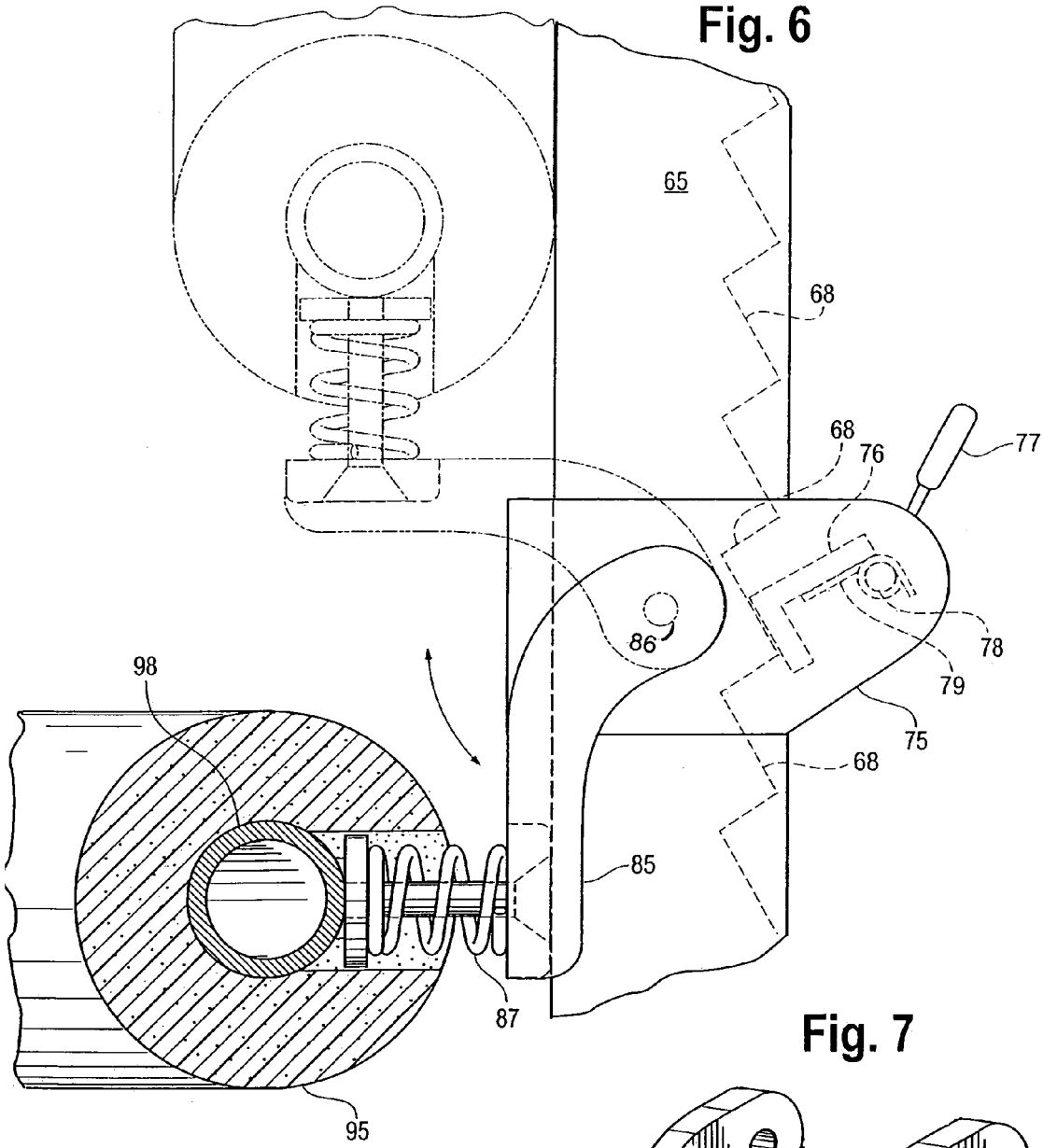
FIG. 6 is a partial side view on one embodiment, showing the body support in cross-section, with the yoke shown for a horizontal position and for a raised position in phantom.

This arrangement can be a rachet mechanism in some embodiments. As best seen in the example of FIGS. 4 and 6, collar 75 can be raised higher along spine 65 simply by pushing it up. The upward force will push catch 76 against a surface of spine 65 which is at an angle with catch area 68, rotating catch 76 against the bias of spring 79 and allowing collar 75 to rise. However, the weight of body support 95 and the various coupling elements (or even pushing collar 75 down) will push catch 76 into catch area 68, will not rotate catch 76, and will not allow collar 75 to fall—unless paddle 77 is rotated about pivot shaft 78 releasing catch 76.

Figure 3:
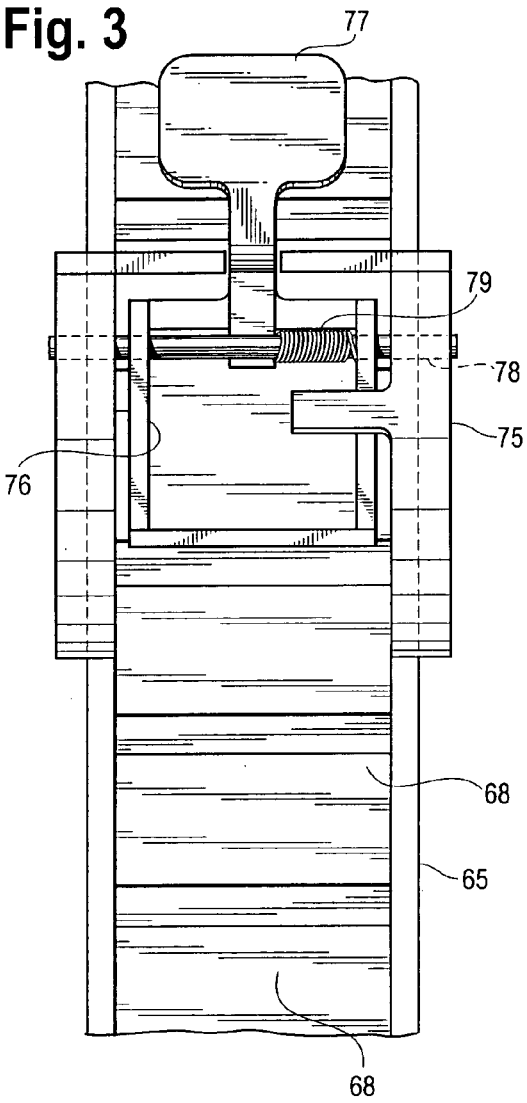
FIG. 3 is a partial rear view, showing parts of the spine, the collar and the catch of one embodiment.
Figure 20:
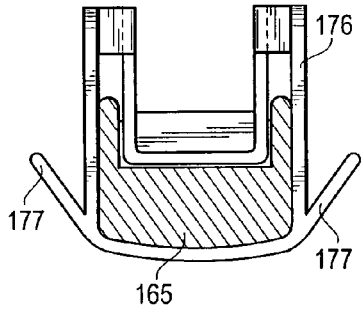
FIG. 20 is a partial top view, showing part of the catch of the embodiment of FIG. 19, with the spine in cross-section.
Figure 19:
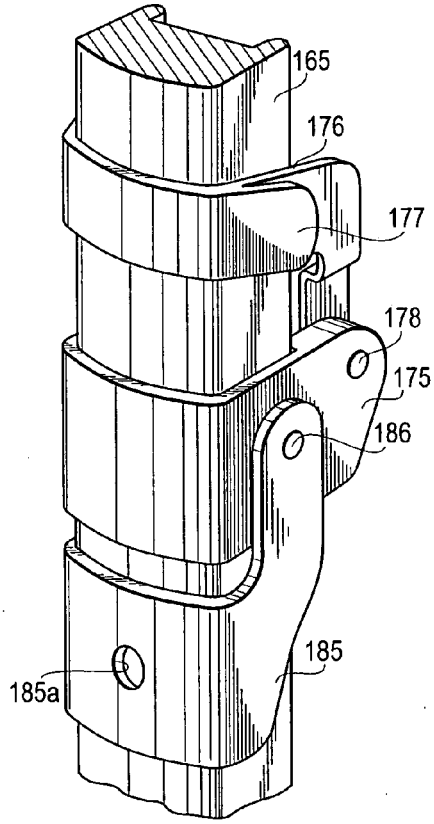
FIG. 19 is a partial perspective view of another emodiment.
Figure 21:
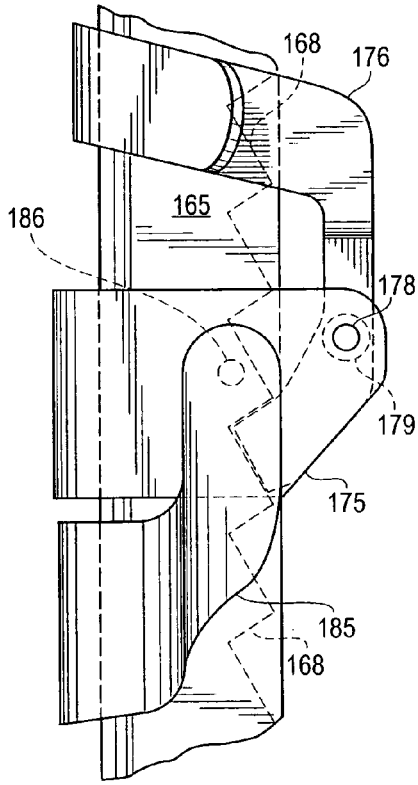
FIG. 21 is a partial side view of the embodiment of FIG. 19.

The embodiment of FIGS. 19 through 21 can operate similarly to the embodiment of FIG. 3. However, in the example of FIGS. 19 through 21, a catch 176 extends around to the front of spine 165 for easy accessibility and operability. Catch 176 is rotatably coupled to collar 175, such as about pivot 178. A spring 179 biases the orientation of catch 176 relative to collar 175, to engage catch 176 in a catch area 168 and to prevent collar 175 from moving along spine 165 in at least one direction. Catch 176 can be rotated about pivot 178 against the bias of spring 179 to move catch 176 out of a catch area 168, and to allow collar 175 to be adjusted up or down along spine 165. In the example of FIGS. 19 through 21, catch 176 includes extensions 177 as one example of a shaped surface, such as a protrusion or an indentation, that can be used by the bather when rotating catch 176. A wing, a button, a handle, a knob, and a grip are other examples of such a protrusion or indentation.

Figure 2:
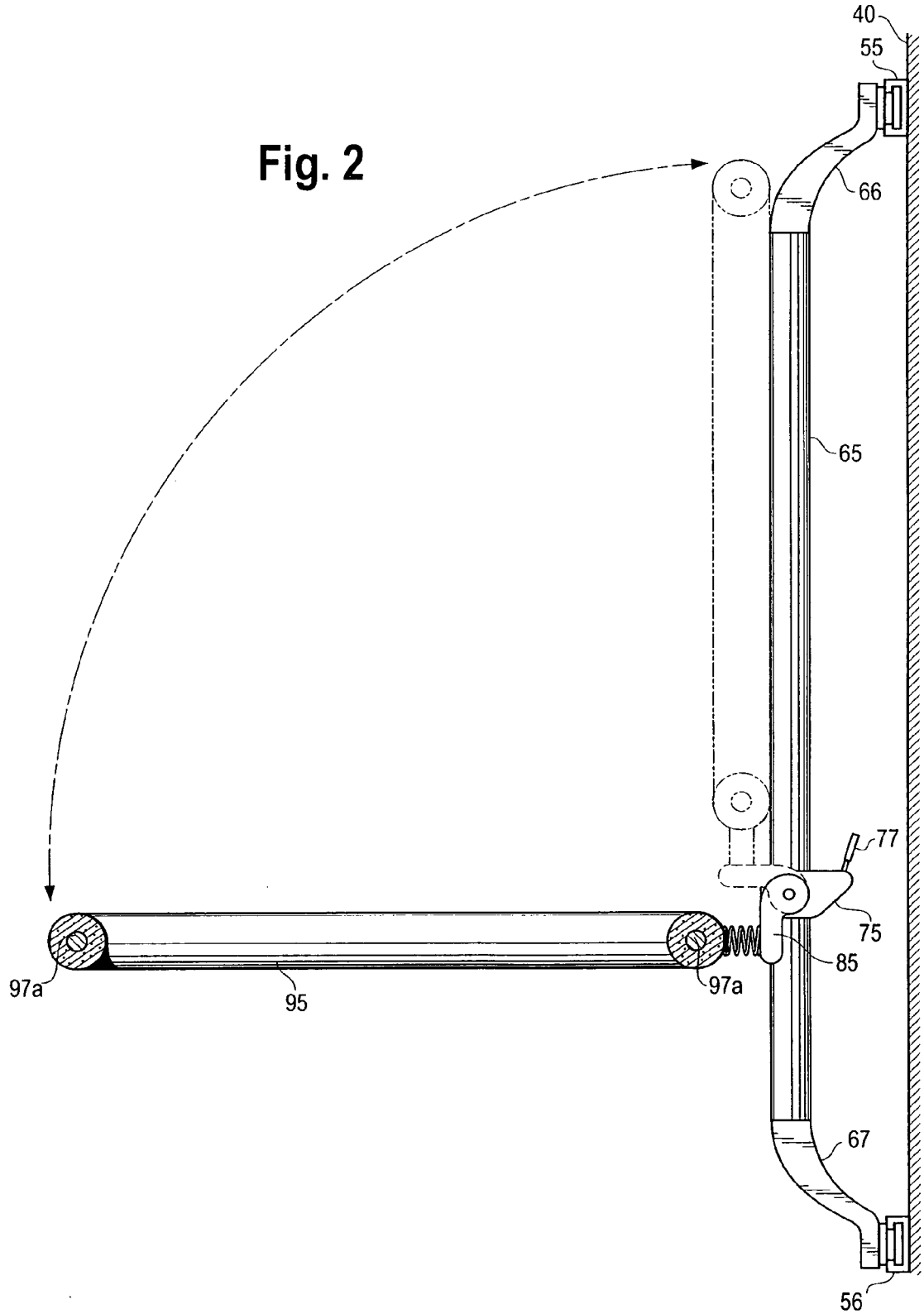
FIG. 2 is a side view in one simulated environment, with the body support shown in a horizontal position, and in a raised position in phantom.
Figure 7:
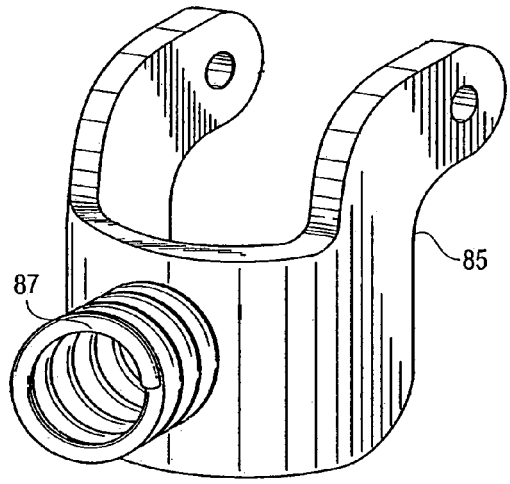
FIG. 7 is a perspective view of the yoke and spring coil of the embodiment of FIG. 6.

A body support, such as body support 95, can be coupled collar 75 in different ways. Some those ways provide for adjusting an angular orientation of a body support relative to a spine. Various examples of means for adjusting that angular orientation are described in the next few paragraphs. For example, as shown in the example of FIGS. 2 and 6, body support 95 is coupled to a yoke 85. FIG. 7 shows a perspective view of one example of a yoke 85 and spring coil 87. As best seen in the example of FIG. 6, yoke 85 can be rotatably coupled to collar 75. For example, yoke 85 can be coupled to collar 75 with riveted pins 86 which allow rotation. Other fasteners can be used in other embodiments, as is well known in the art. The example of FIGS. 19 and 21 also shows a yoke 185 coupled to collar 175 about fasteners 186. A body support can be attached to yoke 185 at point 185*a*, possibly using a spring coil.

In the example of FIGS. 2 and 6, the relationships of body support 95, yoke 85 and spine 65 permit yoke 85 to rotate only about 90°. In other examples, different ranges of rotation can be permitted. In the example of FIGS. 2 and 6, yoke 85 can be rotated down until it meets spine 65. At that point, body support 95 is in a generally horizontal position suitable for use during bathing. Body support 95 can be rotated up to a generally vertical position, which may be more desirable when body support 95 is not being used. Body support 95 is shown in the raised, generally vertical position, in the example of FIG. 1 (and in phantom in FIG. 2).

Yoke 85, collar 75 and catch 76 can be formed of high strength plastic, cast metal such as aluminum or steel, or some other materials. In some examples, there can be an interface, such as a TEFLON® (or synthetic flourine-containing resins) interface, between the collar and the spine to facilitate sliding adjustment of the collar along the spine.

In other embodiments, rotation of a body support relative to a collar can release a catch permitting the collar to move along the spine. For example, in the embodiment of FIGS. 9 through 11, part of the surface of vertical spine 101 facing away from a wall is molded with or otherwise includes successive catch areas 107. A collar 102 can be adjusted up and down spine 101. A catch 106 is rotatably coupled to collar 102 about pivot point 103. A body support (not shown) can be coupled to a connector 105 which is rotatably coupled to collar 102 about pivot point 104.

Figure 10:
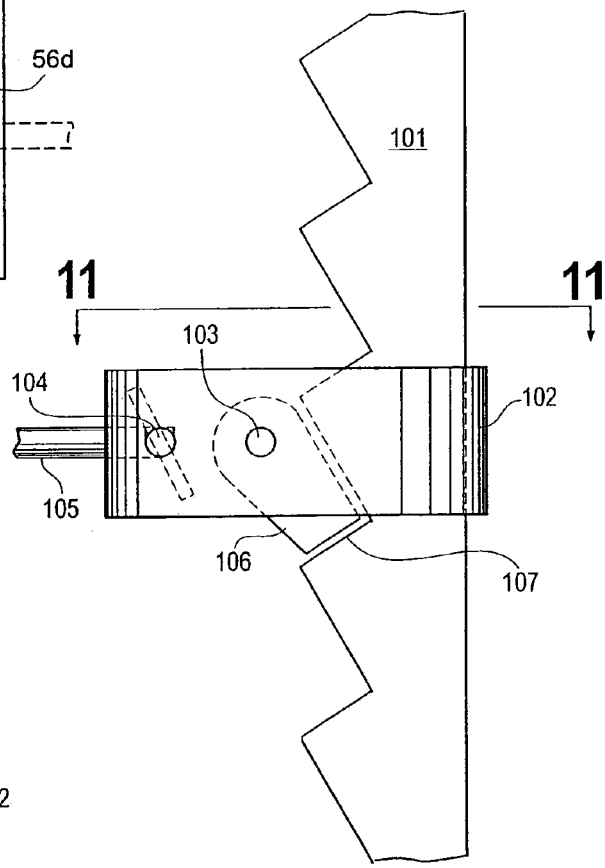
FIG. 10 is a partial side view view of the embodiment of FIG. 9.
Figure 9:
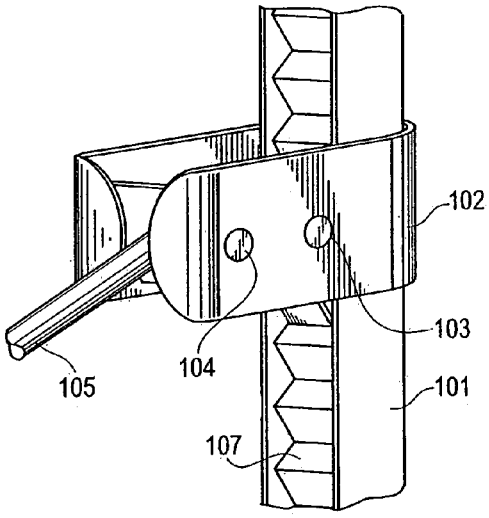
FIG. 9 is a partial perspective view of another embodiment.
Figure 11:
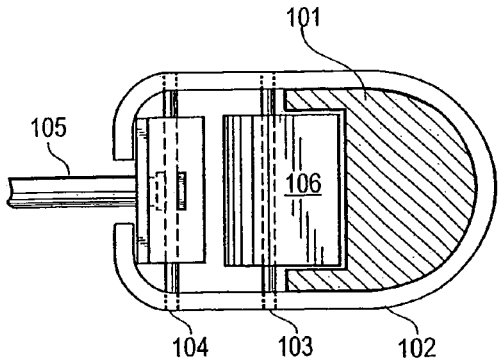
FIG. 11 is a partial cross-sectional top view taken along line 11—11 of FIG. 10.

In the example of FIGS. 9 through 11, catch 106 can be released when connector 105 is in one orientation with respect to collar 102. For example, catch 106 can be released when connector 105 is rotated down and a coupled body support is hanging in a generally vertical position. In that position, collar 102 can be adjusted along spine 101. When connector 105 is rotated up and a coupled body support is in a generally horizontal position suitable for use during bathing, catch 106 is pushed into a catch area 107 along spine 101 preventing collar 102 from sliding down spine 101. In that position, collar 102 can be prevented from sliding up or down in some examples. In other examples, the elements can be arranged as a ratchet mechanism, permitting collar 102 to be raised but not lowered until the connector is rotated relative to the collar.

Figure 22:
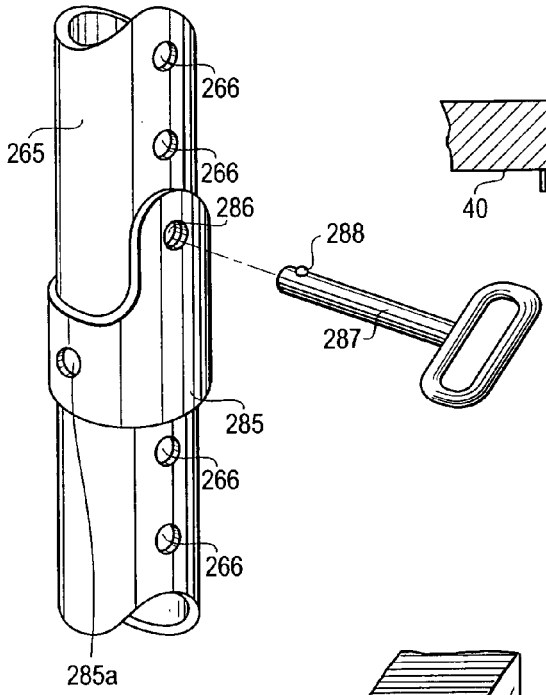
FIG. 22 is a partial perspective view of another embodiment.

FIG. 22 shows an example of a simplified embodiment without collar and catch components. In the example of FIG. 22, spine 265 is a rectangular section without the need for catch areas, but with a series of openings 266. Yoke 285 has openings 286 that can be aligned with openings 266 at a selected height. A latch pin 287 can be inserted through openings 286 and 266 to secure yoke 285 to spine 265 at the selected height. A releasable captive ball catch 288 near one end of latch pin 287 restrains latch pin 287 from falling out, and yoke 285 can pivot about latch pin 287. A body support can be attached to yoke 285 at point 285*a*, possibly using a spring coil. In other examples, other releasable fasteners, or other releasable mechanisms, can be used to secure the yoke to the spine. Preferably, such mechanisms permit rotation of the yoke relative to the spine.

Figure 13:
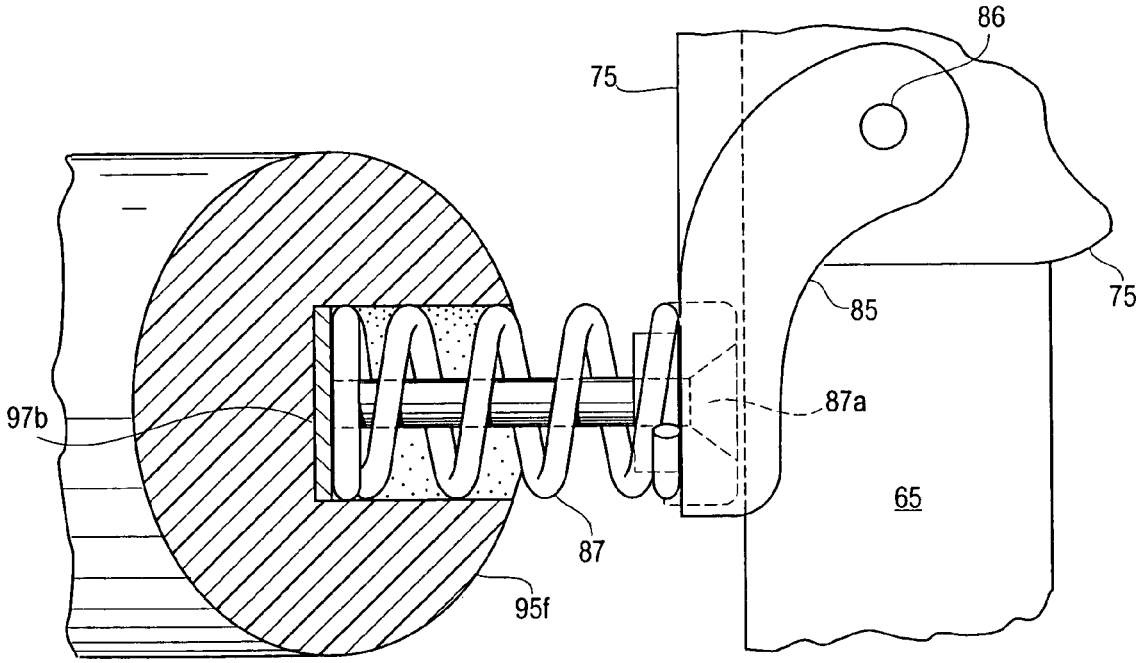
FIG. 13 is a partial side view on another embodiment, showing the body support in cross-section.

Various examples of means for flexing different coupling elements are described in the next few paragraphs. For example, in the embodiment of FIG. 6, body support 95 is coupled to collar 75 by a connector comprising yoke 85 and spring coil 87. Spring coil 87 permits some flexibility and, in some examples, can add to any flexibility inherent in spine 65. In some examples, spring coil 87 can be welded to spring connection 98 as shown in FIG. 6. In the embodiment of FIG. 13, body support 95*f* is coupled to collar 75 by a connector comprising yoke 85 and spring coil 87. Spring coil 87 is shown fastened to yoke 85 by a countersunk flathead machine screw, and is welded to steel ribbon 97*b*. In some examples, spring coil 87 can be surrounded by a foam cover.

Figure 14:
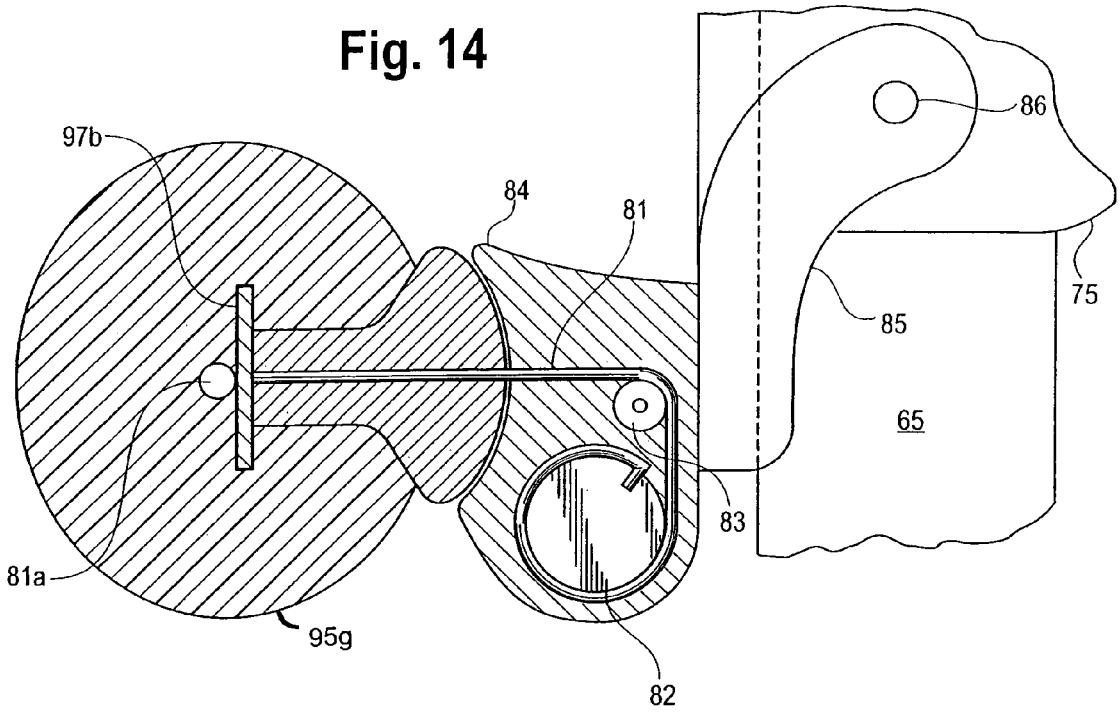
FIG. 14 is a partial side view on another embodiment, showing the body support and the cable and housing in cross-section.

In the embodiment of FIG. 14, body support 95*g* is coupled to collar 75 by a connector comprising yoke 85 and a cable system. In the example of FIG. 14, the cable system comprises a cable 81 passing through a two-part housing 84. Housing 84 can be integral with yoke 85, or can be secured to yoke 85 by screws or other fasteners as is known in the art. A cable attachment 81*a*prevents one end of cable 81 from pulling through steel ribbon 97*b* which reinforces body support 95*g*. In the example of FIG. 14, cable 81 passes over a pulley 83, and the second end of cable 81 is attached to inertial reel 82. Inertial reels, which are known in the art, are spring-loaded and work like seat belt retractors, for example. The cable and reel of the embodiment of FIG. 14 allow the bather to extend the body support for a limited distance away from the spine, and constitute one example of a means for moving a body support a limited distance from a wall.

In other embodiments, other connectors can be used to couple a body support to a collar. For example, connector 105 shown in FIGS. 9 through 11 can be a steel cable in some examples. In some examples, the joint between connector 105 and collar 102 can be a heim-type joint to increase flexibility.

Figure 23:
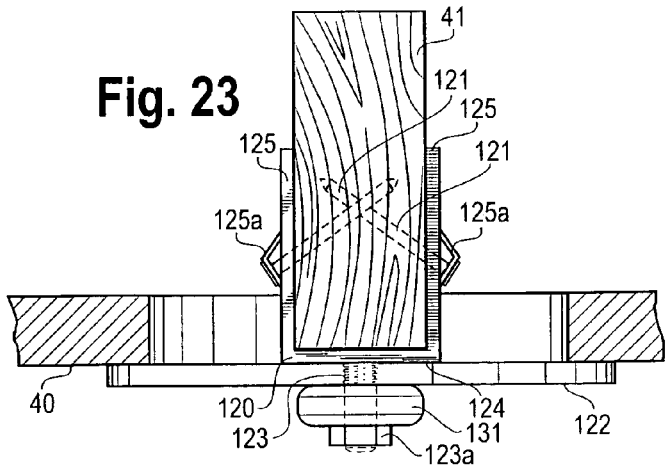
FIG. 23 is a partial top view of another embodiment, in one simulated environment.
Figure 24:
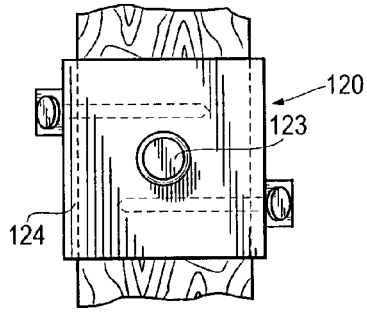
FIG. 24 is a front view of a single point attachment device of FIG. 23.
Figure 25:
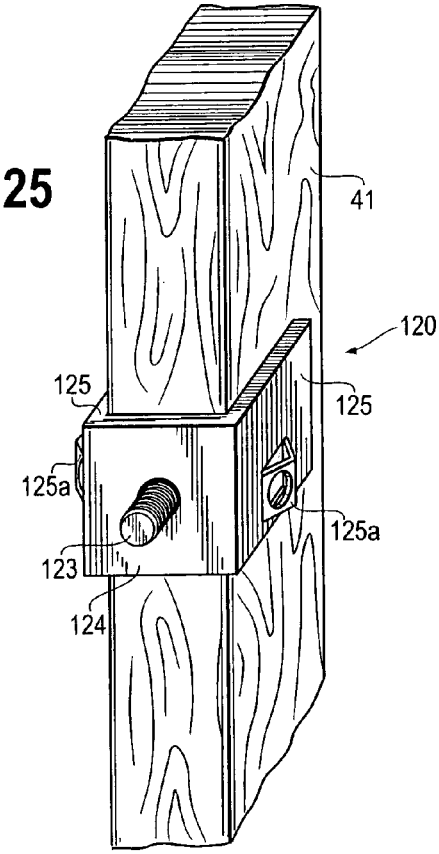
FIG. 25 is a perspective view of a single point attachment device of FIG. 23.

FIGS. 23 through 25 show an example of an embodiment in which a body support (not shown) can be fixed to a single location on a wall. In the example of FIG. 23, a single point attachment device 120 is secured to a column 41, such as a wood stud, through a small opening in a wall 40. For example, as shown in FIG. 23, two wood lag screws 121 can be used to secure single point attachment device 120 to a column 41.

In the example of FIGS. 23 through 25, single point attachment device 120 includes a front 124 and two sides 125, and is dimensioned to fit around the front of a wood stud behind a wall. Each of two sides 125 includes, at point 125*a*, an angled opening, through which fasteners such as screws can be inserted to secure single point attachment device 120 to the wood stud. In the example of FIGS. 23 through 25, front 124 includes an integral threaded shaft 123. As seen in FIG. 23, a cover 122 can fit around shaft 123 and cover the opening in the wall. Single point attachment device 120 can be constructed of 18 gauge stamped steel, or of other materials, thicknesses, and manufacturing methods, as is known in the art.

Figure 26:
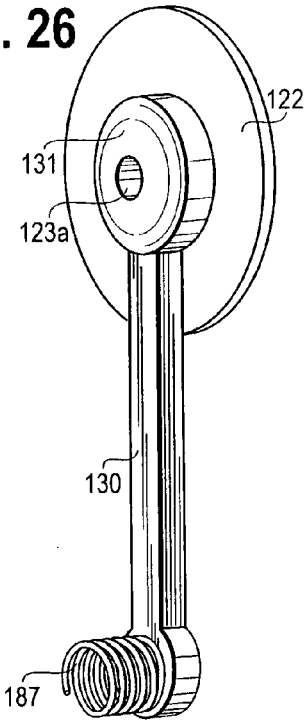
FIG. 26 is a perspective view of a link, with adjoining elements.

In the example of FIGS. 23 and 26, a nut 123*a* secures a link 130 to shaft 123. In that example, link 130 has a heim-type joint 131 at the end secured to single point attachment device 120. A body support can be attached to the other end of link 130. In various embodiments, a semi-flexible connector can attach a body support to a single point attachment device. In some embodiments, for example, a body support can be attached to link 130, such as through a spring coil 187 as seen in the example of FIG. 26. In some embodiments, link 130 can be semi-flexible, and can be composed of hard rubber or other materials known in the art.

As mentioned above, a method contemplated by the invention can be an implementation or a use of any of the different systems or features of those systems, such as those systems and features described above. For example, supporting a person in a shower may include adusting a lateral position of a vertical spine 65, such as for example by moving a slide block 57 in a mounting track 55 that is coupled to a wall of the shower (see e.g., FIGS. 1, 2 and 8). For example, it may include adjusitng a height of a body support 95 along vertical spine 65 (see e.g., FIGS. 1 and 2), and possibly engaging a catch 76 in a catch area 68 of the spine 65 (see e.g., FIGS. 3–6). For example, it may include adjusting an angular orientation of body support 95 relative to vertical spine 65, such as for example by rotating a yoke 85 or other connector 105 (see e.g. FIGS. 2, 6 and 9). For example, it may include separating regions 95*a* and 95*b* of body support 95 to allow entry of the person, positioning body support 95 around the person's chest, and fastening regions 95*a* and 95*b* to each other (see e.g., FIGS. 1 and 17).

From the foregoing it will be observed that numerous modifications and variations can be effectuated without departing from the true spirit and scope of the novel concepts of the present invention. It is to be understood that no limitation with respect to the specific embodiments illustrated is intended or should be inferred.

What is claimed is:

1. A support system to support a person in a shower, the system comprising:
- a body support;
- a coupling element;
- the coupling element capable of coupling the body support to structure that at least partially encloses the shower;
- the coupling element comprising:
  - a) a mounting track;
  - b) a slide block;
- the body support coupled to the slide block;
- the slide block movable in the mounting track;
- the mounting track mountable to the shower enclosing structure;
- at least one stopping surface;
- the at least one stopping surface capable of inhibiting movement of the slide block in at least one direction along the mounting track, when the angle of the slide block is changed relative to the mounting track;
- the body support suitable to fit generally around the person's chest under the person's arms;
- the body support comprising first and second regions;
- the body support allowing separation of the first and second regions;
- wherein, when the first and second regions are separated, the person can enter an area generally bordered by the body support.

2. The support system of claim 1, the at least one stopping surface comprising a series of spaced apart protrusions of the mounting track.

3. The support system of claim 1, the at least one stopping surface comprising at least one protrusion of the slide block.

4. The support system of claim 3, the at least one stopping surface further comprising a series of spaced apart protrusions of the mounting track.

5. The support system of claim 1, the slide block comprising a roller.

6. The support system of claim 1,
- the coupling element further comprising a vertical spine;
- the spine coupled to the slide block;
- the body support coupled to the spine;
- a height of the body support adjustable along the spine.

7. A support system to support a person in a shower, the system comprising:
- a body support;
- a coupling element;
- the coupling element capable of coupling the body support to a wall of the shower;
- the coupling element comprising a vertical spine;
- the spine mountable to the wall;
- a height of the body support adjustable along the spine;
- the coupling element further comprising a rachet mechanism;
- wherein a height of the body support can be raised but will not be lowered unless the rachet mechanism is released;
- the body support suitable to fit generally around the person's chest under the person's arms;
- the body support comprising first and second regions;
- the body support allowing separation of the first and second regions;
- wherein, when the first and second regions are separated, the person can enter an area generally bordered by the body support.

8. The support system of claim 7,
- the ratchet mechanism comprising:
  - a)a collar;
  - b)a catch;
- the body support coupled to the collar;
- the spine comprising a catch area;
- a location of the collar adjustable along the spine;
- the collar prevented from moving in at least one direction along the spine, when the catch engages the catch area;
- the catch movably coupled to the collar;
- wherein movement of the catch relative to the collar can disengage the catch from the catch area.

9. The support system of claim 8,
the catch rotatably coupled to the collar;
the catch comprising a shaped surface available for the person to move the catch relative to the collar;
wherein movement of the shaped surface relative to the collar causes the catch to rotate relative to the collar.

10. The support system of claim 9, the shaped surface comprising at least one of a protrusion, an indentation, an extension, a wing, a button, a handle, a knob, and a grip.

11. The support system of claim 9, the shaped surface located so that, when the body support is around the person's chest, a straight line between the shaped surface and the person's chest generally would not intersect the spine.

12. The support system of claim 8, further comprising:
a bias spring;
the bias spring capable of biasing the catch against disengagement from the catch area.

13. The support system of claim 7, the coupling element further comprising a connector;
the body support coupled to the connector;
a location of the connector adjustable along the spines;
wherein adjusting the location of the connector along the spine adjusts the height of the body support.

14. The support system of claim 13, wherein rotation of the connector can change an orientation of the body support relative to the spine.

15. The support system of claim 14,
the connector rotatable through a range of about 90°;
wherein the connector cannot be rotated lower after the orientation of the body support is generally horizontal.

16. The support system of claim 7, wherein the body support is generally toroidal.

17. The support system of claim 7, the body support further comprising:
metal reinforcement;
foam;
the foam generally surrounding the metal reinforcement;
the foam comprising a waterproof coating.

18. The support system of claim 7,
the body support further comprising a fastening mechanism;
the fastening mechanism capable of securing the first and second regions to each other.

19. The support system of claim 7,
the coupling element further comprising a spring;
the body support coupled to the spring.

20. A support system to support a person in a shower, the system comprising:
a body support;
a coupling element;
the coupling element capable of coupling the body support to a wall of the shower;
the coupling element comprising a vertical spine;
the spine mountable to the wall;
a height of the body support adlustable along the spine;
the coupling element further comprising a cable system;
the cable system comprising a cable;
the body support coupled to the cable;
wherein movement of the cable allows movement of the body support a limited distance from the wall;
the body support suitable to fit generally around the person's chest under the person's arms;
the body support comprising first and second regions;
the body support allowing separation of the first and second regions;
wherein, when the first and second regions are separated, the person can enter an area generally bordered by the body support.

21. The support system of claim 20,
the coupling element further comprising a latch pin and a connector, the connector comprising the cable system;
the latch pin capable of securing the connector to the spine.

22. The support system of claim 21,
the latch pin comprising a captive ball catch;
the captive ball catch capable of releasably retaining the latch pin in place to secure the connector to the spine.

23. The support system of claim 20,
the coupling element further comprising a latch pin and a connector, the connector comprising the cable system;
the spine comprising a series of openings;
the connector comprising at least one opening;
the latch pin capable of securing the connector to the spine at a selected height, by insertion through at least two aligned openings of the spine and the connector, respectively.

24. The support system of claim 20, the cable system comprising an inertial reel.

25. A support system to support a person in a shower, the system comprising:
a body support;
a coupling element;
the coupling element capable of coupling the body support to structure that at least partially encloses the shower;
the coupling element comprising a single point attachment device;
the single point attachment device securable to a column of the shower enclosing structure;
the single point attachment device comprising a front and two sides;
each of the two sides of the single point attachment device being generally perpendicular to the front of the single point attachment device;
the single point attachment device dimensioned to fit around a front of the column with the front of the single point attachment device being generally parallel to the front of the column and with each of the sides of the single point attachment device being generally parallel to sides of the column;
each of the sides of the single point attachment device defining at least one angled opening through which a fastener may be inserted to secure the single point attachment device to the sides of the column;
the body support coupled to the single point attachment device;
the body support suitable to fit generally around the person's chest under the person's arms;
the body support comprising first and second regions;
the body support allowing separation of the first and second regions;
wherein, when the first and second regions are separated, the person can enter an area generally bordered by the body support.

26. The support system of claim 25,
the single point attachment device comprising an integral threaded shaft;
the body support coupled to the shaft.

27. A support system to support a person in a shower, the system comprising:
a body support;
a coupling element;

the coupling element capable of coupling the body support to structure that at least partially encloses the shower;

the coupling element comprising:

a semi-flexible connector;

a single point attachment device;

the single point attachment device securable to a column of the shower enclosing structure;

the connector coupled to the single point attachment device;

the body support coupled to the connector;

the body support suitable to fit generally around the person's chest under the person's arms;

the body support comprising first and second regions;

the body support allowing separation of the first and second regions;

wherein, when the first and second regions are separated, the person can enter an area generally bordered by the body support.

* * * * *